US008037680B2

(12) United States Patent
Breuer et al.

(10) Patent No.: US 8,037,680 B2
(45) Date of Patent: Oct. 18, 2011

(54) HYDRAULIC CONTROL SYSTEM FOR A SWIVELING CONSTRUCTION MACHINE

(75) Inventors: James M. Breuer, Mandan, ND (US); Michael D. Wetzel, Bismarck, ND (US); Alvin A. Liebel, Mandan, ND (US)

(73) Assignee: Clark Equipment Company, West Fargo, ND (US)

( * ) Notice: Subject to any disclaimer, the term of this patent is extended or adjusted under 35 U.S.C. 154(b) by 604 days.

(21) Appl. No.: 12/190,725

(22) Filed: Aug. 13, 2008

(65) Prior Publication Data

US 2009/0044434 A1 Feb. 19, 2009

Related U.S. Application Data

(60) Provisional application No. 60/955,512, filed on Aug. 13, 2007.

(51) Int. Cl.
*E02F 9/22* (2006.01)
*F15B 11/02* (2006.01)

(52) U.S. Cl. ..... 60/424; 37/410

(58) Field of Classification Search ..... 60/420, 60/424, 426; 37/410
See application file for complete search history.

(56) References Cited

U.S. PATENT DOCUMENTS

| | | | | |
|---|---|---|---|---|
| 4,552,503 | A | 11/1985 | Mouri et al. | |
| 4,776,750 | A * | 10/1988 | Griswold et al. | 414/698 |
| 4,949,805 | A | 8/1990 | Mather et al. | |
| 5,282,363 | A * | 2/1994 | Ogawa et al. | 60/420 |
| 5,293,746 | A | 3/1994 | Bianchetta | |
| 5,462,125 | A | 10/1995 | Stratton et al. | |
| 5,911,506 | A | 6/1999 | Nakamura et al. | |
| 6,029,446 | A * | 2/2000 | Duppong et al. | 60/424 |
| 6,032,094 | A | 2/2000 | Yanagi et al. | |
| 6,047,228 | A | 4/2000 | Stone et al. | |
| 6,064,918 | A | 5/2000 | Ohtsukasa et al. | |
| 6,185,493 | B1 | 2/2001 | Skinner et al. | |
| 6,233,511 | B1 | 5/2001 | Berger et al. | |
| 6,286,606 | B1 | 9/2001 | Krieg et al. | |

(Continued)

FOREIGN PATENT DOCUMENTS

DE 10127898 A1 3/2002

(Continued)

OTHER PUBLICATIONS

Search Report and Written Opinion dated Nov. 17, 2008 for International application No. PCT/US2008/009648.

*Primary Examiner* — Thomas E Lazo
(74) *Attorney, Agent, or Firm* — Leanne Taveggia Farrell; Westman, Champlin & Kelly, P.A.

(57) ABSTRACT

A hydraulic control system for a swiveling construction machine includes at least one hydraulic travel motor, a first hydraulic actuation device, a second hydraulic actuation device and a hydraulic diverter valve assembly. The at least one hydraulic travel motor is configured to move the swiveling construction machine in a first travel speed and a second travel speed based on a variable pilot pressure signal. The first hydraulic actuation device is configured to actuate a first function of an implement. The second hydraulic actuation device is configured to actuate a second function of an implement. The hydraulic diverter valve assembly is configured to divert hydraulic power between the first hydraulic actuation device and the second hydraulic actuation device while maintaining operation of the at least one hydraulic travel motor in one of the first and the second speeds.

20 Claims, 6 Drawing Sheets

U.S. PATENT DOCUMENTS

| | | | |
|---|---|---|---|
| 6,837,140 | B2 | 1/2005 | Oka et al. |
| 6,951,067 | B1 | 10/2005 | Dietz et al. |
| 6,981,371 | B2 | 1/2006 | Imanishi et al. |
| 7,007,415 | B2 | 3/2006 | Koch |
| 7,020,553 | B2 | 3/2006 | Nakamura et al. |
| 7,025,148 | B2 | 4/2006 | Hansen |
| 2005/0177292 | A1 | 8/2005 | Okamura et al. |
| 2005/0209759 | A1 | 9/2005 | Lee |
| 2005/0222733 | A1 | 10/2005 | Merten et al. |
| 2006/0287792 | A1 | 12/2006 | Jarrett |
| 2007/0219694 | A1 | 9/2007 | Krimbacher |

FOREIGN PATENT DOCUMENTS

| | | | | |
|---|---|---|---|---|
| EP | 1584824 | A1 | | 10/2005 |
| GB | 2081777 | A | | 2/1982 |
| JP | 11-269939 | | | 10/1999 |
| JP | 2002-81409 | | | 3/2002 |
| JP | 2002081409 | A | * | 3/2002 |
| WO | 2008/044094 | A1 | | 4/2008 |

* cited by examiner

HYDRAULIC CONTROL SYSTEM FOR A SWIVELING CONSTRUCTION MACHINE

CROSS-REFERENCE TO RELATED APPLICATION

The present application is based on and claims the benefit of U.S. provisional patent application Ser. No. 60/955,512, filed Aug. 13, 2007, the content of which is hereby incorporated by reference in its entirety.

BACKGROUND OF THE INVENTION

An excavator is a tracked swiveling construction vehicle that includes an undercarriage that supports a pair of track assemblies and an upperstructure that includes an operator support portion. The pair of track assemblies are powered by motors and are controlled by an operator located in the cab. The undercarriage is equipped with a dozer blade that is fixed to a lift arm also controlled by the operator. Pinned to the upperstructure is an implement assembly including a boom and arm.

The implement assembly includes a bucket, breaker or other attachment coupled to the arm that is configured for excavating and trenching. In operation, the dozer blade is used for grading, leveling, backfilling, trenching and general dozing work. The blade can be used to increase dump height and digging depth depending on its position in relation to the boom and implement assembly. The blade also serves as a stabilizer during digging operations.

The upperstructure can rotate relative to the undercarriage by a swivel. Any hydraulic power that is transmitted to the undercarriage from the upperstructure is typically routed through the hydraulic swivel. For example, travel motors, such as the motors that power the pair of track assemblies, and tools, such as the dozer blade located on the undercarriage, can require hydraulic power. Routing hydraulic fluid through the swivel is complicated by the 360 degree rotation of the upperstructure relative to the undercarriage.

Since the hydraulic connections routed through the swivel are hard-plumbed into the swivel, adding new hydraulically-controlled features to the undercarriage generally requires the design and installation of a unique swivel for each version of an excavator. In addition, each new hydraulic line for each new hydraulically-controlled feature typically requires a separate control mechanism in the upperstructure. Creating and installing a unique swivel and adding separate control mechanisms for each version of an excavator can incur added costs and complexity to the manufacturing process of excavators.

The discussion above is merely provided for general background information and is not intended to be used as an aid in determining the scope of the claimed subject matter.

SUMMARY OF THE INVENTION

A hydraulic control system for a swiveling construction machine includes at least one hydraulic travel motor, a first hydraulic actuation device, a second hydraulic actuation device and a hydraulic diverter valve assembly. The at least one hydraulic motor is configured to move the swiveling construction machine in a first speed and a second speed based on a variable pilot pressure signal. The first hydraulic actuation device is configured to actuate a first function of an implement. The second hydraulic actuation device is configured to actuate a second function of an implement. The hydraulic diverter valve assembly is configured to divert hydraulic power between the first hydraulic actuation device and the second hydraulic actuation device while maintaining operation of the at least one hydraulic travel motor in one of the first and the second speeds. The at least one hydraulic travel motor, the first hydraulic actuation device, the second hydraulic actuation device and the hydraulic diverter valve assembly can all be coupled to an undercarriage in the swiveling construction vehicle and the variable pilot pressure signal can be generated from the pilot manifold of the swiveling construction vehicle.

These and various other features and advantages will be apparent from a reading of the following Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

Embodiments of the disclosure describe a way to modify an existing swiveling construction machine to add an additional hydraulic control to the undercarriage without having to change the swivel itself, and with minimal changes to the controls in the upperstructure of the machine. In particular, embodiments of the disclosure describe ways that multi-function tools or implements can be added to the undercarriage of the machine after manufacture without having to change the swivel and only having to make minimal changes to the controls. For example, an excavator (a type of swiveling construction machine) could be manufactured with a single-function tool coupled to the undercarriage. For example, a normal dozer blade includes the single-function of lifting. However, the single-function tool could be replaced with a multi-function tool. For example, an angled dozer blade includes the function of lifting as well as the function of angling.

Figure 1:
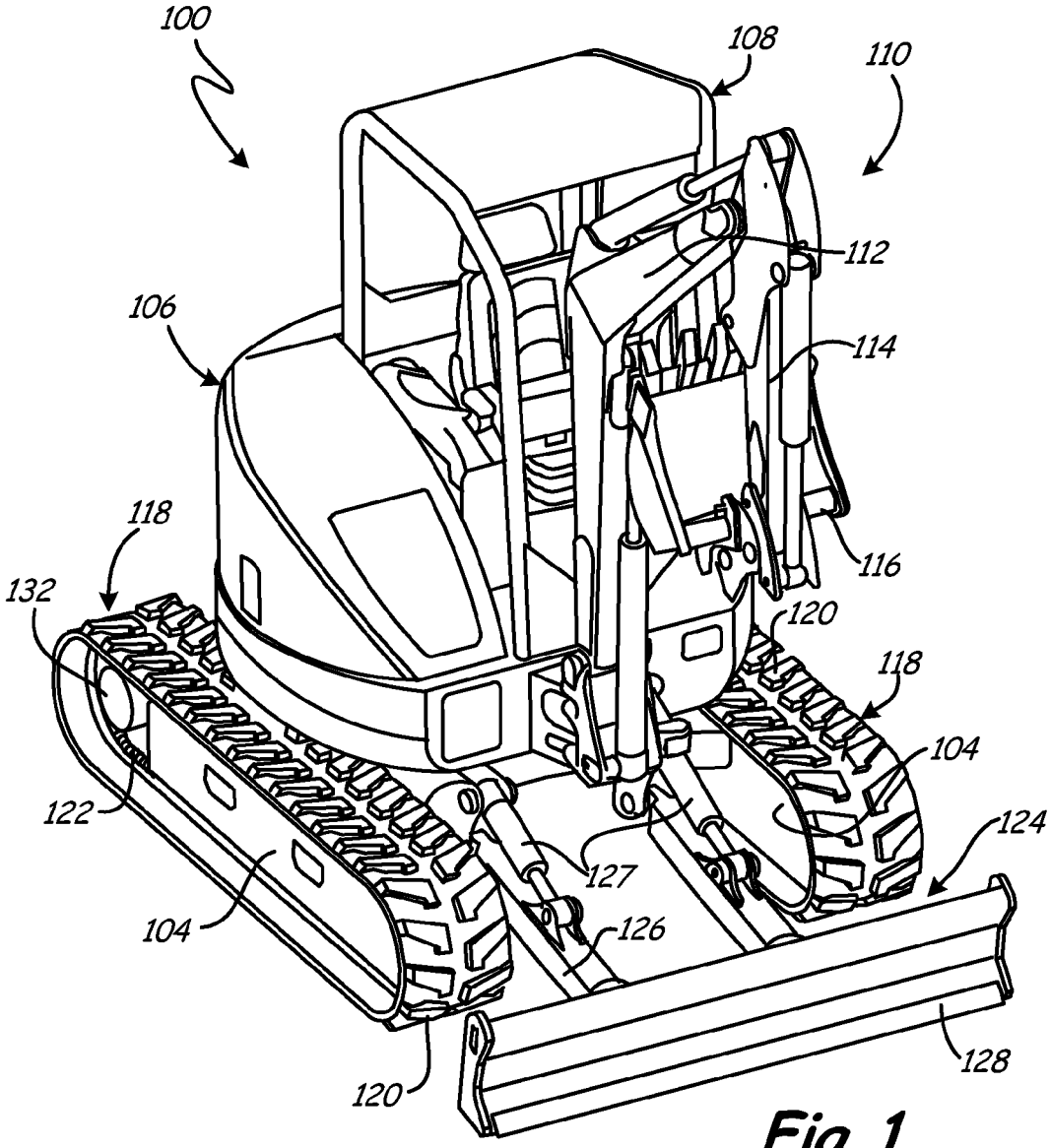
Fig. 1 (PRIOR ART)
FIG. 1 illustrates a perspective view of a prior art excavator.

FIG. 1 illustrates a perspective view of a prior art compact excavator 100. Compact excavator 100 includes an undercarriage 104, an upperstructure 106 including an operator support structure 108 and a primary implement assembly 110 pinned to upperstructure 106. Primary implement assembly 110 includes a boom 112, an arm 114 and an arm mounted attachment 116. As illustrated in FIG. 1, arm mounted attachment 116 is a bucket. However, those skilled in the art will recognize that other types of attachments can be used, such as a breaker or an auger.

Undercarriage 104 is configured to support a pair of tracking assemblies 118 located on the left and right sides of compact excavator 100. Each track assembly 118 includes a track 120 that is rotatable about a sprocket 122 (only one sprocket is shown in FIG. 1). Each sprocket 122 is powered by a travel motor controlled through manipulation of suitable controls in operator support structure 108.

Figure 2:
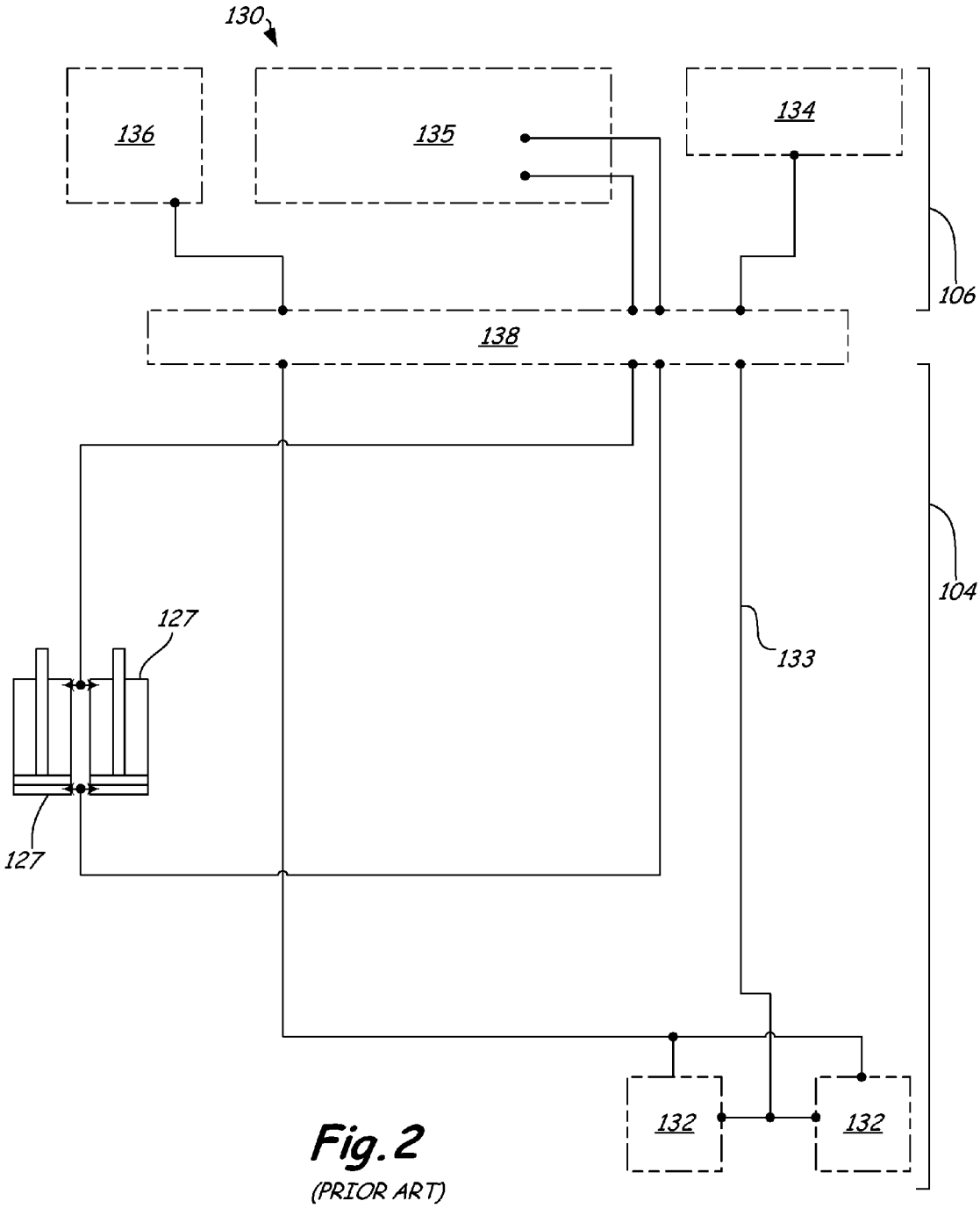
Fig. 2 (PRIOR ART)
FIG. 2 illustrates a schematic block diagram of a hydraulic control system in the excavator illustrated in FIG. 1.

FIG. 2 illustrates a schematic diagram of a hydraulic control system 130 for an excavator, such as excavator 100. Some swiveling construction machines or excavators, such as excavator 100 (FIG. 1), utilize a pilot signal 133 to change the speed of hydraulic travel motors 132 that power each sprocket 122 (FIG. 1) of the each track assembly 118 (FIG. 1). For example, each hydraulic travel motor 132 for each track assembly 118 can be a two-speed travel motor that is toggled between a first or low speed and a second or high speed. The pilot signal 133 is generated by a pilot manifold 134 in the upperstructure 106. In such an arrangement, the pilot signal 133 varies between a low pressure (possibly even zero pressure) and a high pressure. For example, the motors 132 can be toggled between the two speeds by momentarily pressing a button on a joystick. A computer or other electronic controller in the machine receives the signal from the button and changes the state of the pilot manifold or solenoid valve, such that the output pilot pressure is high or low as appropriate. The high or low pilot pressure signal 133 is then transmitted to the travel motors 132 to switch between the first and second speed modes.

Referring back to FIG. 1, compact excavator 100 also includes a secondary implement assembly 124. Secondary implement assembly 124 is attached to undercarriage 104 of compact excavator 100. Secondary implement assembly 124 includes a lift arm assembly 126 and a work tool or implement 128. Lift arm assembly 126 is pivotally coupled to undercarriage 104. Lift arm assembly 126 is configured to rotate through an arc centered on a lift arm pivot axis upon actuation by a pair of hydraulic actuators 127. Work tool 128 is a single-function tool. In particular and as illustrated in FIG. 1, work tool 128 is a dozer blade. However, it should be realized that work tool 128 can be other types of implements. In operation, the dozer blade 128 is used for grading, leveling, backfilling, trenching and general dozing work. The blade can be used to increase dump height and digging depth depending on its position in relation to the boom and implement assembly. The blade also serves as a stabilizer during digging operations. In general, the single-function dozer blade is limited to the range of motion of lift arm assembly 126.

Referring to FIG. 2, hydraulic control system 130 illustrates the hydraulics used to operate hydraulic actuators 127 coupled to lift arm assembly 126 (FIG. 1). It should be realized that some swiveling construction machines or excavators, include a separate system from the hydraulic travel system for operating the hydraulic actuators 127 coupled to the lift arm assembly 126. However, in FIG. 2, both systems are shown as hydraulic control system 130. The hydraulic actuators 127 operate to control the lift or height of the work tool 128 using a main control valve 135 in the operator support structure 108 of the upperstructure 106. For example, the lifting or lowering of lift arm assembly 126 is controlled by a joystick or lever, where moving the joystick or lever raises and lowers the blade. In addition, hydraulic control system 130 can also include a return or overflow hydraulic tank 136 located in the upperstructure 106 of compact excavator 100.

Each of the hydraulic components that are housed in the upperstructure of an excavator, such as upperstructure 106 of excavator 100, are coupled to an undercarriage, such as undercarriage 104, through a fluid-tight hydraulic swivel 138. A plurality of fluid-tight swivel connectors are included in hydraulic swivel 138 and are designed to couple a set of hydraulic lines. The fluid-tight swivel connections allow the upperstructure 106 to rotate relative to the undercarriage 104 via a slew bearing in a full 360 degrees. While the use of flexible hoses or tubing can also provide a fluid-tight coupling instead of the use of a hydraulic swivel, the flexible hoses or tubing provide limited rotation by not allowing continuous 360 degrees of movement. To allow a 360 degree rotation, a fluid-tight hydraulic swivel is used in swiveling construction machines to provide multiple hydraulic fluid connections across a continuously rotatable interface.

When the need arises for an additional, separately controllable hydraulic line in the undercarriage that was not previously put in place at the time of manufacture of the excavator, usually a different hydraulic swivel is installed. For example, if a single-function tool in an existing excavator is swapped out for a multi-function tool, a different hydraulic swivel is also installed in the existing excavator to accommodate the need for the separate controllable hydraulic lines. Although a more complex hydraulic swivel could be installed at manufacture to accommodate any new hydraulic fluid lines for the future, this would require multiple different versions of the machine to be manufactured depending the types of tools that will be added to the undercarriage. Installing a different hydraulic swivel is laborious and difficult and making multiple versions of a machine increases complexity and cost in the manufacturing process. Therefore, embodiments discussed below modify an excavator to hydraulically control a multi-function tool instead of a single-function tool without installing a different hydraulic swivel.

Figure 3:
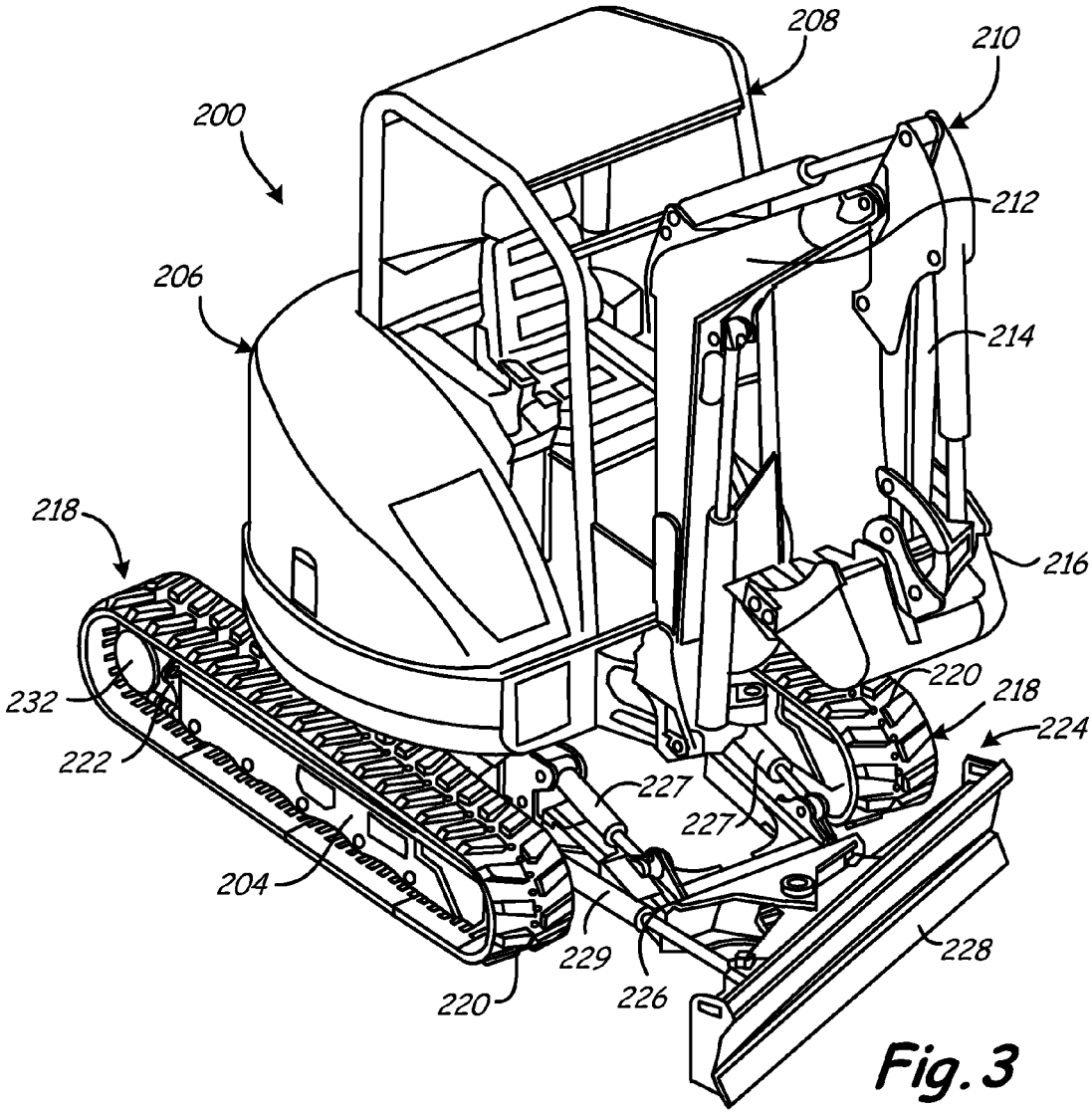
FIG. 3 illustrates a perspective view of an excavator under one embodiment.

FIG. 3 illustrates a perspective view of a compact excavator 200 under one embodiment. Like compact excavator 100 of FIG. 1, excavator 200 includes an undercarriage 204, an upperstructure 206 including an operator support structure 208 and a primary implement assembly 210 pinned to upperstructure 206. Primary implement assembly 210 includes a boom 212, an arm 214 and an arm mounted attachment 216.

Undercarriage 204 supports a pair of tracking assemblies 218 located on the left and right sides of compact excavator 200. Each track assembly 218 includes a track 220 that is rotatable about a sprocket 222 (only one sprocket is shown in FIG. 3). Each sprocket 222 is powered by a hydraulic travel motor controlled through manipulation of suitable controls in operator support structure 208.

Compact excavator 200 also includes a secondary implement assembly 224. Secondary implement assembly 224 is attached to undercarriage 204 of compact excavator 200. Secondary implement assembly 224 includes a work tool or implement 228. In the FIG. 3 embodiment, work tool 228 is a multi-function tool instead of the single-function tool 128 illustrated in FIG. 1. Like work tool 128, work tool 228 can perform the functions of the single-function work tool using a first actuation device 227 (i.e., a pair of lift arm hydraulic actuators). In the embodiment illustrated in FIG. 3, a lift arm assembly 226 is pivotally coupled to undercarriage 204. Lift arm assembly 226 is configured to rotate through an arc centered on a lift arm pivot axis upon actuation by the first actuation device or pair of lift arm hydraulic actuators 227.

However, in addition to this first function, work tool 228 can perform further functions. For example, secondary implement assembly 224 further includes a second actuation device 229. In FIG. 3, second actuation device 229 is an angle hydraulic actuator. In the embodiment where work tool 228 is an angled dozer blade 228, angle hydraulic actuator 229 can angle blade 228 to the side, which provides work tool 228 with more functionality than that of dozer blade 128. This sidewise motion is illustrated in FIG. 3.

It should be realized that other types of multi-function work tools with at least a first actuation device and a second actuation device can be coupled to undercarriage 204 for use in excavating than that of the angled dozer blade that is illustrated in FIG. 3. For example, an angled sweeping tool can be added to undercarriage 204. A first actuation device attached to the undercarriage 204 can utilize hydraulic power to adjust a sweeping angle of the sweeping tool to the side. A second actuation device attached to the undercarriage 204 can utilize hydraulic power to rotate the sweeper. In another example, a forklift attachment can be added to undercarriage 204. A first actuation device attached to undercarriage 204 can utilize hydraulic power to adjust the height of the fork. A second actuation device attached to undercarriage 204 can utilize hydraulic power to adjust the angle of the fork relative to horizontal.

Figure 4:
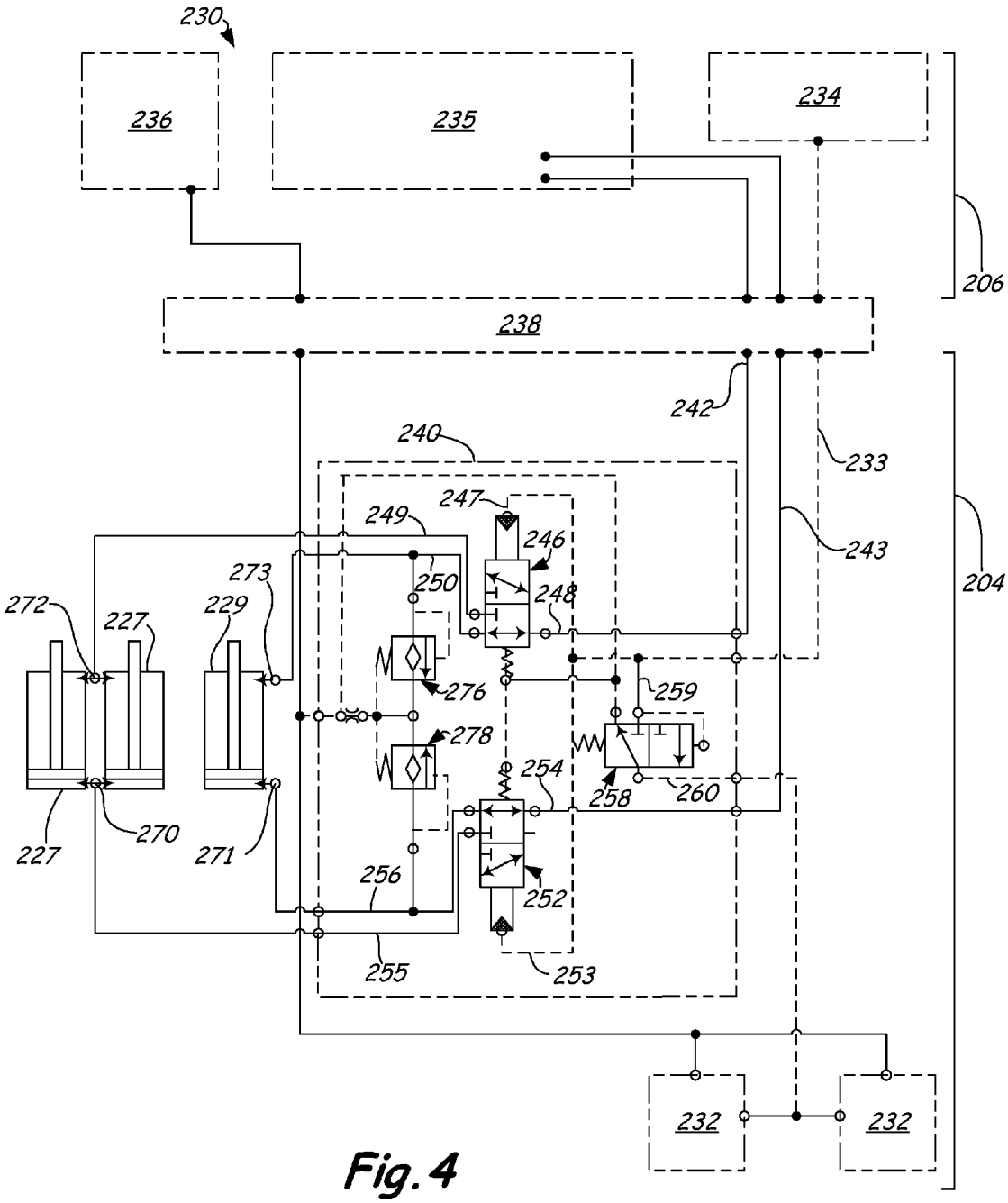
FIG. 4 illustrates a schematic block diagram of a hydraulic control system implemented in the excavator illustrated in FIG. 3.

FIG. 4 illustrates a schematic diagram of a hydraulic control system 230 for a swiveling construction machine or excavator 200 (FIG. 3) under one embodiment. To allow a multi-function tool to be coupled to the secondary implement assembly 224 (FIG. 3) without having to install a different hydraulic swivel, as discussed above, a hydraulic diverter valve assembly 240 is installed in a hydraulic control system 230 of excavator 200. More specifically, hydraulic diverter valve assembly 240 is installed on the undercarriage 204 of excavator 200 and is controlled by a variable pressure pilot signal 233. The hydraulic diverter valve assembly 240 can be used to divert hydraulic power between a first actuation device 227, such as lift actuators 227 on secondary implement assembly 224 (FIG. 3), and a second actuation device 229, such as angle actuator 229 that is also attached to secondary implement assembly 224.

Hydraulic diverter valve assembly 240 includes a collection of pressure activated valves 246, 252 and 258 that are operably connected to the pilot pressure signal line 233 as well as valves 246 and 252 to the hydraulic power supply lines 242 and 243 for powering the first actuation device 227 and the second actuation device 229 of work tool 228 (FIG. 3). Each pressure activated valve 246, 252 and 258 has an input 247, 253, 259 for the line of the variable pilot pressure signal line 233. Each of the pressure activated valves 246 and 252 have an input 248 and 254 for one of the hydraulic power supply lines 242 and 243 that extend from a main control valve 235 in the upperstructure 206 of excavator 200 (FIG. 3). Each of the pressure activated valves 246 and 252 have two outputs 249, 250 and 255, 256 for routing hydraulic power to first actuation device 227 and second actuation device 229, respectively.

Figure 5:
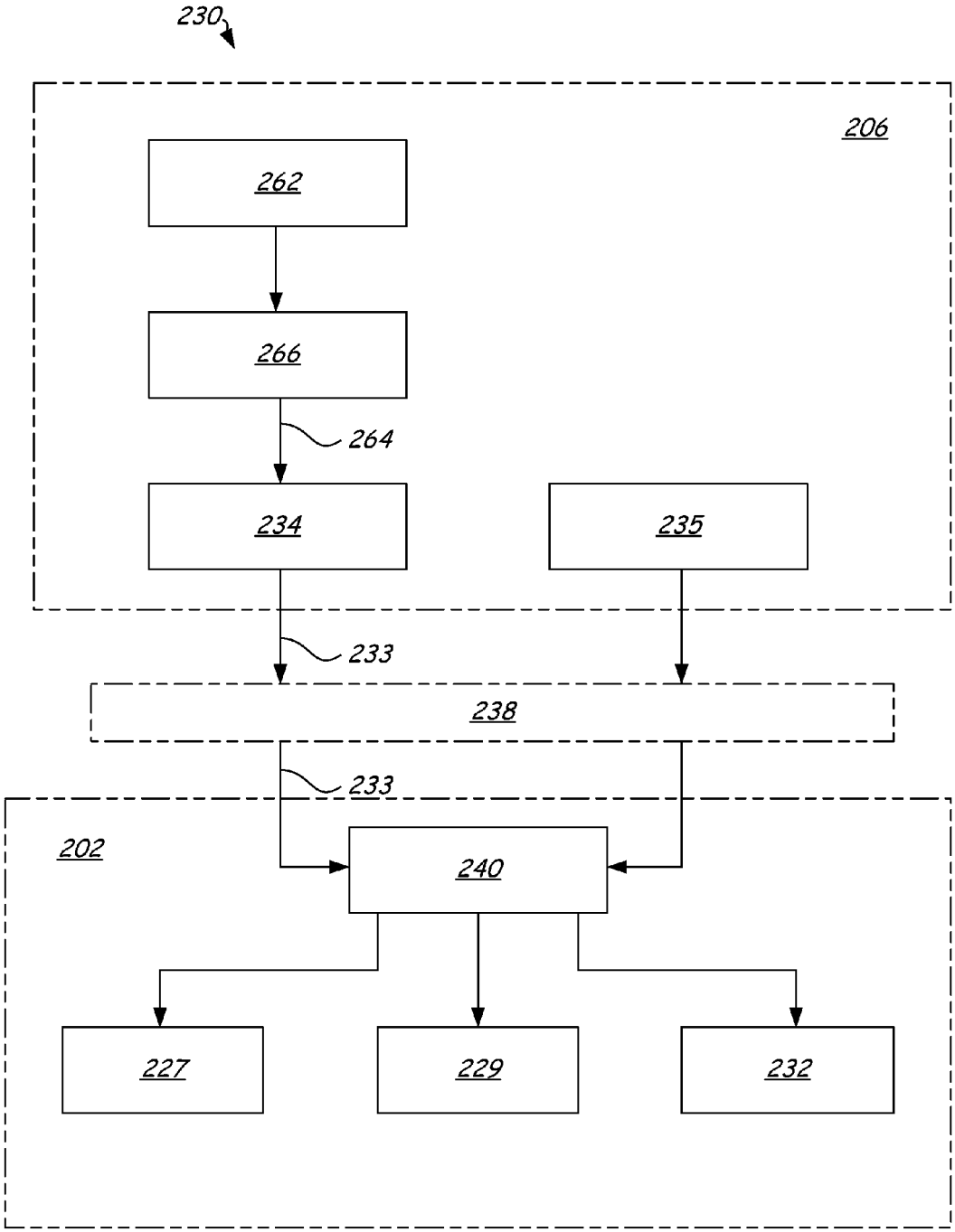
FIG. 5 illustrates a schematic block diagram of a hydraulic control system implemented in the excavator illustrated in FIG. 3.

FIG. 5 illustrates a more basic schematic block diagram of the hydraulic control system 230 illustrated in FIG. 4. Using the variable pilot pressure signal 233, diverter valve assembly 240 operates to switch the hydraulic power between the first actuation device 227 and the second actuation device 229. To accomplish this, pilot pressure signal 233 is generated by a pilot manifold or variable solenoid valve 234. In one embodiment, the variable solenoid valve 234 is controlled by a pulse-width modulated (PWM) signal 264 originating from a controller 266 via a joystick button 262 that is actuated by an operator located in upperstructure 206.

In one embodiment, variable pilot pressure signal 233 is varied between a first level of pressure or low pressure ($P_0$), a second level of pressure or intermediate pressure ($P_1$) and third level of pressure or high pressure ($P_2$). Variable pilot pressure signal 233 is transmitted from upperstructure 206 to undercarriage 204 through hydraulic swivel 238, and is then connected to hydraulic diverter valve assembly 240. With reference back to FIG. 4, in hydraulic diverter valve assembly 240, variable pilot pressure signal 233 is routed to a travel motor pressure activated valve 258 and one or more actuator pressure activated valves 246 and 252. In one embodiment, the pressure activated valves 246, 252 and 258 can be valves having pressure controlled springs, where the stiffness of the spring determines the pressure at which the valve switches from one state to another.

In one embodiment, the pair of actuator pressure activated valves 246 and 252 are responsive to a first mid level pressure $P_{mid1}$ (i.e., a pressure between first level of pressure $P_0$ and second level of pressure $P_1$) and are used to connect the hydraulic power from main control valve 235 to either first actuation device 227 or to second actuation device 229 of the work tool 228 (FIG. 3) based on a level of the variable pilot pressure signal. When the pilot pressure signal is at a level of pressure that is less than first mid level pressure $P_{mid1}$, such as first level of pressure $P_0$, the hydraulic power from the main control valve 235 is routed by the actuator pressure activated valves 246 and 252 to the second actuation device 229. When the pilot pressure signal is at a level of pressure that is greater than first mid level pressure $P_{mid1}$, such as second level of pressure $P_1$ or third level of pressure third level of pressure $P_2$ the hydraulic power from main control valve 235 is routed by the actuator pressure activated valves 246 and 252 to first actuation device 227.

In another embodiment, an output 260 of travel motor pressure activated valve 258 opens in response to a second mid level pressure $P_{mid2}$ (i.e., a pressure between second level of pressure $P_1$ and third level of pressure $P_2$) and is then routed out of hydraulic diverter valve assembly 240 to travel motors 232. Therefore, a pilot pressure signal at a level below second mid level pressure $P_{mid2}$ puts travel motors 232 located in undercarriage 204 in a first or low speed mode, while a pilot pressure signal at a level above second mid level pressure $P_{mid2}$ puts travel motors 232 in a second or high speed mode.

As previously discussed, in the embodiment illustrated in FIGS. 3-5, first actuation device 227 includes a pair of lift actuators 227 for raising and lowering work tool 228, while second actuation device 229 includes an angle actuator 229 for angling work tool 228. In the embodiment illustrated in FIG. 4, one of the pair of actuator pressure activated valves 252 is connected to the base side 270 and 271 of each actuator 227 and 229, while the other of the pair of actuator pressure activated valves 246 is connected to the rod side 272 and 273 of each actuator 227 and 229.

When considering the first level of pressure or low pressure ($P_0$), the second level of pressure or intermediate pressure ($P_1$) and the third level of pressure or high pressure ($P_2$) of the pilot signal and the thresholds for activation of the pressure activated valves 246, 252 and 258, namely that first mid level pressure $P_{mid1}$ is between $P_0$ and $P_1$ and second mid level pressure $P_{mid2}$ is between $P_1$ and $P_2$, the following table can be constructed:

| | Mode | | |
|---|---|---|---|
| | 3 | 1 | 2 |
| Pilot Pressure | $P_0$ | $P_1$ | $P_2$ |
| Actuator activated valves 246 and 252 | $P_{mid1}$ | | |
| Travel motor activated valve 258 | | $P_{mid2}$ | |

-continued

| | Mode | | |
|---|---|---|---|
| | 3 | 1 | 2 |
| Low speed travel | X | X | |
| High speed travel | | | X |
| First actuation device 227 | | X | X |
| Second actuation device 229 | X | | |

In one embodiment, mode 3 is activated by holding down joystick button 262 continuously for at least 0.5 seconds, for example. The hydraulic control system 230 (FIGS. 4 and 5) of excavator 200 (FIG. 3) remains in mode 3 for as long as the joystick button 262 is held down. While in mode 3, movement of the joystick 261 activates second actuation device 229 (e.g., changes the angle of dozer blade 228 (FIG. 3)). When the excavator's hydraulic control system 230 detects a continuous button hold for more than 0.5 seconds, the controller sends the appropriated signal, via PWM, to the pilot manifold 234 (FIGS. 4 and 5) to deliver a pilot pressure of $P_0$. Given the responsiveness of the travel motor and actuator pressure activated valves 246, 252 and 258 (FIG. 4) in diverter valve assembly 240 (FIGS. 4 and 5), this pilot pressure level puts the travel motors 232 (FIGS. 4 and 5) in low speed and transfers hydraulic power to the second actuation device 229 (FIGS. 4 and 5). Release of joystick button 262 reverts the pilot pressure signal back to mode 1.

When the button is momentarily pressed (e.g., less than 0.5 seconds) and released, the system switches between modes 1 and 2. In mode 1, the machine's controller 266 signals the pilot manifold 234, via PWM, to set the pilot pressure at second level of pressure $P_1$. At this intermediate pressure $P_1$, the actuator pressure activated valves 246 and 252 route the hydraulic power to the first actuation device 227 (e.g., activates lift actuators to raise or lower dozer blade 228) while the travel motors 232 are signaled by the travel motor pressure activated valve 258 to be in low speed.

When switching from mode 1 to mode 2, actuator pressure activated valves 246 and 252 remain in the same state, since in both mode 1 and mode 2 the pressure is greater than first mid level pressure $P_{mid1}$. Therefore, in mode 2, first actuation device 227 continues to be powered. In both modes 1 and 2, movement of the joystick causes the first actuation device 227 to cause dozer blade 228 or other type of implement to move up and down. In mode 2, pressure is at third level of pressure $P_2$, which is sufficiently elevated (i.e., above second mid level pressure $P_{mid2}$) to change travel motors 232 from the first speed to the second speed. In one embodiment, the pressure at which the two-speed travel motors 232 switch from the first to the second speed may be less than third level of pressure $P_2$, but the motor speed will not change until the pilot pressure signal 233 is above the second mid level of pressure $P_{mid2}$ because travel motor pressure activated valve 258 does not divert the pilot pressure signal 233 to the motors 232 until the second mid level of pressure $P_{mid2}$ is reached (e.g., until the pilot pressure 233 is set to third level of pressure $P_2$).

In each case, the position of joystick button 262 is monitored by a computer or other electronic controller 266, which translates the button signal into a PWM signal that causes the pilot pressure manifold 234 to generate the appropriate pilot pressure signal 233 (FIGS. 4 and 5).

In the embodiment illustrated in FIG. 4, diverter valve assembly 240 also includes one or more relief valves 276 and 278 in-line with the hydraulic power lines to angle actuator 229, at either or both of the base 271 and the rod sides 273. These relief valves 276 and 278 are configured to relieve pressure in the hydraulic lines in response to pressures that exceed a threshold pressure. In one example, the threshold pressure is set at 4000 psi. At 4000 psi, relief valves 276 and 278 will open to relieve the hydraulic pressure in the line caused by the dozer blade or other implement 228 hitting an obstruction that can generate pressure on the angle actuator 229. Upon opening of a relief valve 276 or 278, some excess hydraulic fluid is sent to the return or hydraulic tank 236 (FIG. 4).

Figure 6:
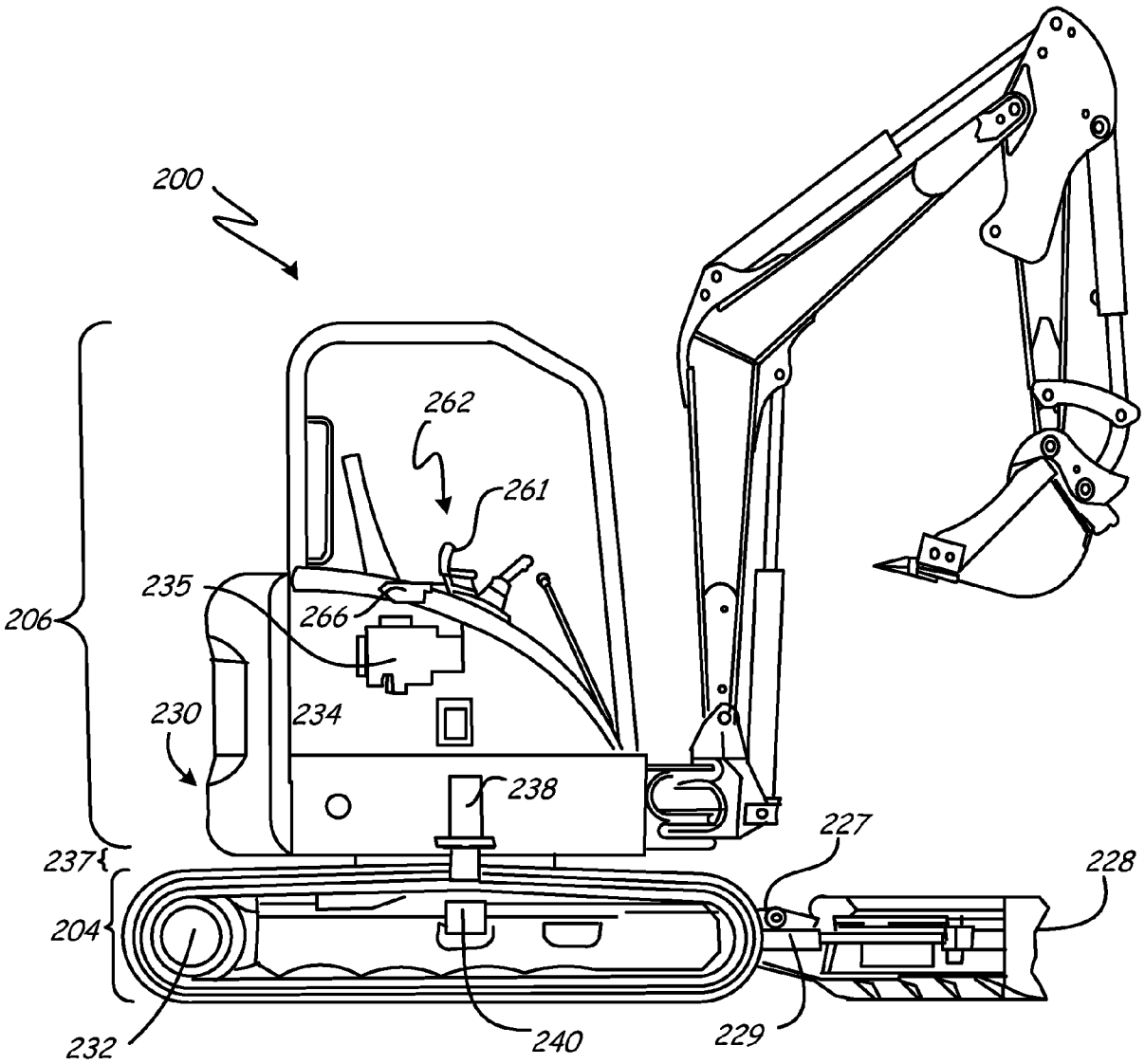
FIG. 6 illustrates a side view of the excavator illustrated in FIG. 3.

The advantages of this system will be apparent to those skilled in the art and will be discussed thoroughly with FIG. 6. FIG. 6 illustrates a side view of excavator 200 with some components visible that would otherwise not be. As previously discussed, control system 230 includes components on upperstructure 206 and on undercarriage 204. Components on upperstructure 206 include a joystick 261 with joystick button 262, a controller 266, a main control valve 235 and a pilot valve or manifold 234. Coupling the upperstructure 206 to undercarriage 204 is a swivel bearing 237. The swivel bearing 237 allows upperstructure 206 to rotate relative to undercarriage 204. Hydraulic power transmitted from upperstructure 206 to undercarriage 204 is routed through hydraulic swivel 238. Components on undercarriage 204 include a hydraulic diverter valve assembly 240, lift actuators 227, angle actuator 229, travel motors 232 and a dozer blade or other type of implement 228.

The hydraulic control system 230 (also illustrated in FIGS. 4 and 5) in excavator 200 can be used to separately control additional hydraulic components on the undercarriage 204. In upperstructure 206 of excavator 200, the electronic controls can be modified to recognize a continuous push of the joystick button 262 and to transmit the appropriate PWM signal 264 (FIG. 5) to pilot pressure manifold 234 to change the pilot pressure accordingly. In the undercarriage 204, hydraulic diverter valve assembly 240 can be installed such that the pilot pressure signal 233 (FIGS. 4 and 5) is transmitted through the hydraulic diverter valve assembly 240 and then coupled to travel motors 232 and lift and angle actuators 227 and 229.

As previously discussed, the approach of using a multiplexed pilot signal to control several different hydraulic cylinders on undercarriage 204, using an existing hydraulic swivel 238, can be generalized to other tools besides an angled dozer blade that is illustrated in FIGS. 3 and 6. In one embodiment, a six way dozer blade can be added, so that in a first mode, the hydraulic power from main control valve 235 controls an actuator that adjusts the dozer blade angle and in a second mode, the hydraulic power adjusts the dozer blade oscillation. In another embodiment, a forklift attachment can be added to undercarriage 204, so that in a first mode the hydraulic power from main control valve 235 controls an actuator to adjust the height of the fork and in a second mode, the hydraulic power from main control valve 235 controls an actuator to adjust the angle of the fork relative to horizontal.

One skilled in the art will also recognize that the principles of the above-discussed hydraulic system can be used to provide a greater degree of multiplexing so that more than two separate functions can be operated with a single pilot signal and hydraulic power line. Adding a wider range of intermediate pressure control valves permits three or more hydraulic devices to be controlled independently, based on the pressure level of the variable pressure pilot signal. To achieve these additional levels of control require intermediate pressure controlled valves having a high degree of sensitivity and responsiveness with a narrow band of pressures in order to create the wider pressure "bandwidth" that is needed. In addition, the ability to accurately generate and transmit the pilot pressure signal through swivel 238 and into diverter valve 240.

Although the present invention has been described with reference to preferred embodiments, workers skilled in the art will recognize that changes may be made in form and detail without departing from the spirit and scope of the invention.

What is claimed is:

1. A hydraulic control system for a swiveling construction machine comprising:

at least one hydraulic travel motor configured to move a swiveling construction machine in a first speed and a second speed based on a variable pilot pressure signal;

a first hydraulic actuation device configured to actuate a first function of an implement;

a second hydraulic actuation device configured to actuate a second function of an implement; and a hydraulic diverter valve assembly configured to divert hydraulic power between the first hydraulic actuation device and the second hydraulic actuation device while simultaneously maintaining operation of the at least one hydraulic travel motor so that the at least one hydraulic travel motor is capable of shifting between the first speed and the second speed, the hydraulic diverter valve assembly coupled to the variable pilot pressure signal and configured to divert the hydraulic power between the first hydraulic actuation device and the second hydraulic actuation device and shift the at least one hydraulic travel motor based on a level of the variable pilot pressure signal.

2. The hydraulic control system of claim 1, wherein the hydraulic diverter valve assembly comprises a pair of actuator pressure activated valves that are responsive to a first mid level pilot pressure ($P_{mid1}$) of the variable pilot pressure signal that is between a first level of pressure ($P_0$) and a second level of pressure ($P_1$), the actuator pressure activated valves configured to divert hydraulic power from the second hydraulic actuation device to the first hydraulic actuation device upon receiving a pilot pressure greater than the first mid level pilot pressure ($P_{mid1}$).

3. The hydraulic control system of claim 2, wherein the hydraulic diverter assembly comprises a travel motor pressure activated valve responsive to a second mid level pilot pressure ($P_{mid2}$) of the variable pilot pressure signal that is between the second level of pressure ($P_1$) and a third level of pressure ($P_2$), the travel motor pressure activated valve configured to change the at least one hydraulic travel motor from operating in the first speed to operating in the second speed upon receiving a pilot pressure greater than the second mid level pilot pressure ($P_{mid2}$).

4. The hydraulic control system of claim 3, wherein the at least one hydraulic travel motor is operated in the first speed when a pilot pressure is at the first level of pressure ($P_0$) or the second level of pressure ($P_1$) and wherein the at least one hydraulic travel motor is operated in the second speed when a pilot pressure is at the third level of pressure ($P_2$).

5. The hydraulic control system of claim 2, wherein the hydraulic diverter assembly further comprises a pair of relief valves coupled to hydraulic lines that extend between the actuator pressure activated valves and the second actuation device, the pair of relief valves are configured to relieve pressure in the hydraulic lines in response to pressures that exceed a threshold pressure.

6. The hydraulic control system of claim 1, wherein the pilot pressure signal is generated by a variable solenoid valve in a pilot manifold, the variable solenoid valve is controlled by a signal originating from a controller coupled to a joystick button that is operable by an operator.

7. The hydraulic control system of claim 1, wherein the first actuation device operates to raise and lower the work implement by actuating a lift arm assembly that is coupled to the work implement.

8. The hydraulic control system of claim 7, wherein the second actuation device operates to angle the work implement by actuating the work implement into an angle relative to the lift arm assembly.

9. A swiveling construction vehicle comprising:

an upperstructure including a primary implement assembly, the upperstructure configured to generate a variable pilot pressure signal;

an undercarriage comprising:

a pair of rotatable track assemblies, each track assembly rotated by a hydraulic travel motor that can be operated in a first speed and a second speed;

a secondary implement assembly having a multi-function work implement controlled by the variable pilot pressure signal, a first function of the work implement is operable using a first hydraulic actuation device and a second function of the work implement is operable using a second hydraulic actuation device;

a swivel coupling the upperstructure to the undercarriage, the swivel configured to allow the upperstructure to rotate relative to the undercarriage and to accommodate hydraulic lines and a line for the variable pilot pressure signal that extends between the upperstructure and the undercarriage; and a hydraulic diverter valve assembly housed in the undercarriage and configured to divert hydraulic power between the first hydraulic actuation device and the second hydraulic actuation device while simultaneously maintaining operation of each hydraulic travel motor so that each hydraulic travel motor is capable of shifting between the first and the second speeds, the hydraulic diverter valve assembly coupled to the pilot pressure signal and configured to divert the hydraulic power and shift each hydraulic travel motor based on a level of the variable pilot pressure signal.

10. The swiveling construction vehicle of claim 9, wherein the diverter valve assembly comprises a pair of actuator pressure activated valves that are responsive to a first mid level pilot pressure ($P_{mid1}$) of the variable pilot pressure signal that is between a first level of pressure ($P_0$) and a second level of pressure ($P_1$), the actuator pressure activated valves configured to divert hydraulic power from the second hydraulic actuation device to the first hydraulic actuation device upon receiving a pilot pressure greater than the first mid level pilot pressure ($P_{mid1}$).

11. The swiveling construction vehicle of claim 10, wherein the diverter assembly comprises a travel motor pressure activated valve responsive to a second mid level pilot pressure ($P_{mid2}$) of the variable pilot pressure signal that is between the second level of pressure ($P_1$) and a third level of pressure ($P_2$), the travel motor pressure activated valve configured to change the at least one hydraulic travel motor from operating in the first speed to operating in the second speed upon receiving a pilot pressure that is greater than the second mid level pilot pressure ($P_{mid2}$).

12. The hydraulic control system of claim 11, wherein the hydraulic travel motors are operated in the first speed when a pilot pressure is at the first level of pressure ($P_0$) or at the second level of pressure ($P_1$) of the variable pilot pressure signal and wherein the hydraulic travel motors are operated in the second speed when a pilot pressure is at the third level ($P_2$) of pressure.

13. The swiveling construction vehicle of claim 10, wherein the hydraulic diverter assembly further comprises a pair of relief valves coupled to hydraulic lines that extend between the actuator pressure activated valves and the second actuation device, the pair of relief valves are configured to relieve pressure in the hydraulic lines in response to pressures that exceed a threshold pressure.

14. The swiveling construction vehicle of claim 9, wherein the pilot pressure signal is generated by a variable solenoid valve in a pilot manifold, the variable solenoid valve is controlled by a signal originating from a controller coupled to a joystick button that is operable by an operator in an operator support portion of the upperstructure.

15. The swiveling construction vehicle of claim 9, wherein the first actuation device operates to raise and lower the work implement by actuating a lift arm assembly that is coupled to the multi-function work implement.

16. The swiveling construction vehicle of claim 15, wherein the second actuation device operates to angle the multi-function work implement by actuating the multi-function work implement into an angle relative to the lift arm assembly.

17. A method of modifying an excavator that operates a single-function work implement on a undercarriage to operating a multi-function work implement on the undercarriage, the method comprising:

providing an excavator comprising:

an upperstructure;

an undercarriage;

a hydraulic swivel that rotatably couples the upperstructure to the undercarriage and houses hydraulic connections that extend between the upperstructure and the undercarriage;

a pair of hydraulic travel motors;

a multi-function work implement coupled to the undercarriage;

a first hydraulic actuation device configured to operate a first function of the multi-function work implement;

a second hydraulic actuation device configured to operate a second function of the multi-function work implement;

installing a hydraulic diverter valve assembly in the undercarriage, the diverter valve assembly configured to divert hydraulic power between the first hydraulic actuation device and the second hydraulic actuation device while maintaining operation of each hydraulic travel motor in one of a first and a second speed, the hydraulic diverter valve assembly coupled to a variable pilot pressure signal from the upperstructure and configured to divert the hydraulic power based on a level of the variable pilot pressure signal; and changing controls in the upperstructure to coordinate with the diverter valve assembly.

18. The method of claim 17, wherein the hydraulic diverter valve assembly comprises a pair of actuator pressure activated valves that are responsive to a first mid level pilot pressure ($P_{mid1}$) of the variable pilot pressure signal that is between a first level of pressure ($P_0$) and a second level of pressure ($P_1$), the actuator pressure activated valves configured to divert hydraulic pressure from the second hydraulic actuation device to the first hydraulic actuation device upon receiving a pilot pressure greater than the first mid level pilot pressure ($P_{mid1}$).

19. The method of claim 18, wherein the hydraulic diverter assembly comprises a travel motor pressure activated valve responsive to a second mid level pilot pressure ($P_{mid2}$) of the variable pilot pressure signal that is between the second level of pressure ($P_1$) and a third level of pressure ($P_2$), the travel motor pressure activated valve is configured to change the at least one hydraulic travel motor from operating in the first speed to operating in the second speed upon receiving a pilot pressure that is greater than the second mid level pilot pressure ($P_{mid2}$).

20. The method of claim 19, wherein changing the controls in the upperstructure to coordinate with the hydraulic diverter valve assembly comprises:

changing the controls in the upperstructure such that first, second and third modes of pilot pressure can be sent to the diverter assembly;

wherein, in the first mode, a second level of pilot pressure ($P_1$) is set and therefore the actuator pressure activated valves are activated to route hydraulic power to the first actuation device and maintain the hydraulic motors in the first speed;

wherein, when switching between the first mode and the second mode, a third level of pilot pressure ($P_2$) is set and therefore the travel motor pressure activated valve is activated to route hydraulic power to the travel motors to change the travel motors from the first speed to the second speed while the actuator pressure activated valves remain activated and maintain hydraulic power routed to the first actuation device; and wherein, when switching between the first mode and the third mode, a first level of pilot pressure ($P_0$) is set and therefore the actuator pressure activated valves are deactivated and route hydraulic power to the second actuation device and maintain the hydraulic motors in the first speed.

* * * * *